US005591558A

United States Patent [19]

Yamazaki et al.

[11] Patent Number: 5,591,558

[45] Date of Patent: Jan. 7, 1997

[54] IMAGE FORMING METHOD

[75] Inventors: Hiroshi Yamazaki; Takeo Oshiba; Yoshihiko Etoh, all of Hachioji, Japan

[73] Assignee: Konica Corporation, Japan

[21] Appl. No.: 604,082

[22] Filed: Feb. 20, 1996

[30] Foreign Application Priority Data

Feb. 24, 1995 [JP] Japan ..... 7-036795

[51] Int. Cl.[6] ..... G03G 13/08

[52] U.S. Cl. ..... 430/120; 430/58; 430/67; 430/111

[58] Field of Search ..... 430/58, 67, 111, 430/120

[56] References Cited

U.S. PATENT DOCUMENTS 4,702,986 10/1987 Imai et al. ..... 430/120

FOREIGN PATENT DOCUMENTS 57-030846 2/1982 Japan .
1-205172 8/1989 Japan .
2-118667 5/1990 Japan .

*Primary Examiner*—Roland Martin
*Attorney, Agent, or Firm*—Jordan B. Bierman; Bierman and Muserlian

[57] ABSTRACT

An electrostatic image forming method is disclosed. The photoreceptor containing an organic photosensitive material has a layer containing fine particles at the photoreceptor surface; toner has at least binder resin, coloring agent, and releasing agent made of polyolefines in which the ratio, Mz/Mn, is is 3–20, and Mz is 20,000–70,000 wherein Mz is Z-average molecular weight in terms of polypropylene and Mn is the number average molecular weight in terms of polypropylene. No offset phenomenon occurs, and a stable image having no fogging and no black-spots can be formed for a long period of time by the invention.

10 Claims, 1 Drawing Sheet

IMAGE FORMING METHOD

BACKGROUND OF THE INVENTION

The present invention relates to an image forming method comprising a developing process by which an electrostatic latent image formed on a photoreceptor is developed by developer.

In an image forming method by an electrophotographic method, an electrostatic latent image formed on a photoreceptor is developed by developer containing toner for forming a toner image, and after the toner image is transferred onto an image supporting body such as a transfer sheet, or the like, an image is formed by being thermally fixed. On the other hand, the photoreceptor is discharged after a transfer process, next, any remaining toner on the photoreceptor is cleaned off, and the photoreceptor is ready for the next image formation.

In the fixing process in this type of image formation method, it is widely conducted to form a fixed image by a heat roller fixing unit. However, in fixing using the heat roller, fused toner components are transferred and adhered to the heat roller surface, and a so-called offset phenomenon, in which the adhered toner components transfer again onto the next feeding transfer sheet and stain the image, tends to occur. Conventionally, as a means for preventing the occurrence of the offset phenomenon, a releasing agent is contained in toner as a toner component so that the toner itself has the parting property. Here, low molecular weight polyolefine is appropriately used as the releasing agent.

Conventionally, as a photoreceptor used for image formation, inorganic photoreceptors such as selenium, cadmium sulfide, or the like, are widely known. Recently, however, from the viewpoint of the environmental contamination prevention, organic photoreceptors are more commonly being used. As such organic photoreceptors, a so-called multi-layered type organic photoreceptor is used in which a charge generation layer and a charge transport layer are stratified, through an adhesion layer when necessary, on a conductive supporting member.

However, when image formation is carried out using the above-described multi-layered type organic photoreceptor for a long period of time, since, normally, the charge transport layer made of resins containing charge transport materials is worn out by conducting the cleaning process or the like, image formation can not be effectively carried out for a long period of time.

In order to solve this problem, the following photoreceptors are disclosed:

- an organic photoreceptor having, at the surface, a coating layer, in which hydrophobic silica is dispersed, is formed (Japanese Patent Publication Open to Public Inspection No. 118667/1990);
- an organic photoreceptor having, at the surface, a protective layer containing fine metallic particles or fine metallic oxide particles, having an average particle size of less than 0.3 μm, is formed (Japanese Patent Publication Open to Public Inspection No. 30846/1982); and
- a photoreceptor having, at the surface, a protective layer, containing an inorganic filler, is formed (Japanese Patent Publication Open to Public Inspection No. 205172/1989).

These technologies are intended to increase the wear resistance of the photoreceptor surface, and thereby the durability of the photoreceptor, by providing the protective layer, containing each kind of fine particles, at the photoreceptor surface.

Due to the above technologies, although the wear resistance of the photoreceptor surface is increased, the hardness of the surface is also increased and thereby toner components tend to adhere to the photoreceptor surface. As a result, the following problem occurs: an insulating film is formed on the photoreceptor surface (so-called filming phenomenon), and thereby the potential voltage of the photoreceptor surface is not sufficiently lowered, resulting in fogging. Further, black-spot image defects occur on the formed image due to the influence of adhered toner components on the photoreceptor surface.

As described above, a stable image can not be formed for a long period of time, due to adopting such image forming methods, using photoreceptors which are intended to increase the durability by providing wear resistance on the photoreceptor with a surface protective layer.

SUMMARY OF THE INVENTION

The present invention is based on the above-described situations. An object of the present invention is to provide an image forming method by which no offset phenomenon occurs, and which can form a stable image, having no image defects such as fogging or black-spotting, for a long period of time.

Low molecular weight components such as releasing agents (low molecular weight polyolefine), of which toner is composed, tend to adhere to the surface of the organic photoreceptor, the hardness of which can be raised by containing fine particles.

When a specific dispersibility is given to the molecular weight distribution of polyolefine, which is a releasing agent, and low molecular weight components are reduced so that the molecular weight distribution is shifted toward the high molecular weight side, then, the offset prevention effect by the releasing agent is not deteriorated, and the adherence amount of toner components on the surface of the organic photoreceptor is greatly reduced. The present invention has been accomplished according to the above-described results of the study.

That is, an image forming method of the present invention is structured as follows. The image forming method of the invention comprises a development process in which an electrostatic latent image on a photoreceptor is developed by developer wherein the photoreceptor is an organic photoreceptor having a protective layer, containing fine particles, at the photoreceptor surface; toner has at least a binder resin, a coloring agent, and a releasing agent. The releasing agent consists of polyolefine having molecular weight characteristics, that is, a ratio (Mz/Mn) is 3–20, and Mz is 20,000–70,000, wherein Mz is Z-average molecular weight in terms of polypropylene and Mn is the number average molecular weight in terms of polypropylene.

Regarding polyolefine, which is a releasing agent and of which toner is composed, when a ratio (Mz/Mn) of the Z-average molecular weight to the number average molecular weight is 3–20, and the Z-average molecular weight (Mz) is adjusted to be within the range of 20,000–70,000, a ratio of low molecular weight components, which tend to adhere to the photoreceptor surface, is reduced, and a ratio of high molecular weight components, having a low adherence property, is increased. As a result, generation of image defects, such as black-spotting or the like, is prevented, and the offset prevention effects due to the releasing agents are greatly exhibited.

BRIEF DESCRIPTIONS OF THE DRAWINGS

DETAILED DISCLOSURE OF THE INVENTION

Figure 1:
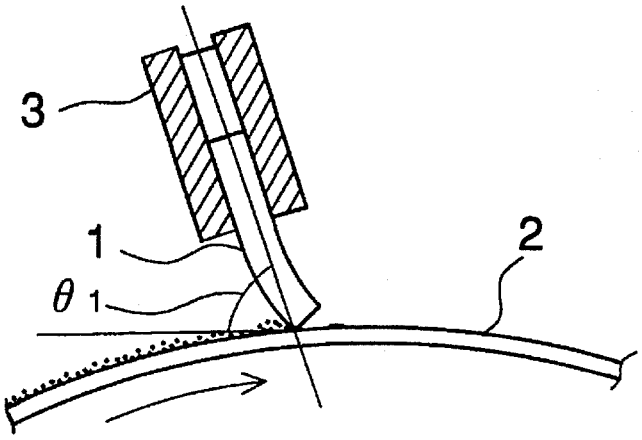
FIG. 1 is an illustration showing an example of a motion of a cleaning mechanism.

The image forming method of the present invention will be detailed below.

Composition of the photoreceptor (1) Composition

The photoreceptor used in the image forming method of the present invention is an organic photoreceptor having a layer containing fine particles, at its surface.

The following can be listed as such types of photoreceptor:

- an organic photoreceptor in which a charge generation layer, a charge transport layer and a layer containing fine particles (hereinafter, called a fine particle-containing surface layer) are formed on a conductive supporting body, through an adhesive layer (hereinafter, called a foundation layer), when necessary; and
- an organic photoreceptor in which a photosensitive layer, in which charge generation material and charge transport material are contained as a mixture (hereinafter, called simply a photosensitive layer), and a fine particle-containing surface layer are formed on a conductive supporting body, through a foundation layer, when necessary.

When the charge generation layer or the charge transport layer, or the photosensitive layer is a surface layer of the photoreceptor, and fine particles are contained in each of these surface layer, it is not necessary to provide another independent fine particle-containing surface layer.

(2) Conductive supporting body

For a conductive supporting body, the following may be used: a conductive supporting body in which a metallic layer such as aluminum, palladium, gold, etc., is laminated or vapor deposited on the surface of a flexible supporting body formed of a metallic plate such as aluminum, stainless steel, iron, etc., paper or plastic film, or the like; or a conductive supporting body in which a layer containing conductive compound such as conductive polymer, indium oxide, tin oxide, etc., is coated or vapor deposited on the surface of the flexible supporting body.

(3) Foundation layer

As a foundation layer, used when necessary, the following can be listed for the material: casein, polyvinyl alcohol, nitro-cellulose, ethylene-acrylic acid copolymer, polyvinyl butyral, phenol resin, polyamides (nylon 6, nylon 66, alkoxy methylated nylon, etc.), polyurethane, gelatin, aluminium oxide, and the like. It is preferable that the film thickness of the foundation layer is 0.1–10 μm, and more preferably, 0.1–5 μm.

(4) Charge generation layer

The charge generation layer contains a charge generation material. The charge generation material contains, but not limited to, phthalocyanine pigment, polycyclic quinone pigment, azo pigment, perylene pigment, indigo pigment, quinacridone pigment, azulenium pigment, squarilium pigment, cyanine dyes, pyrilium dyes, thiopyrilium dyes, triphenylmethane dyes and styryl dyes. One or more kinds of these materials can be used by itself or dispersed in a resin.

The resin, in which the charge generation material is dispersed, includes styrene-acryl resins, bisphenol A type polycarbonates, bisphenol Z type polycarbonates, polyester resins, acryl resins, polyvinyl chloride resins, polyvinylidene chloride resins, styrene resins, polyvinyl acetates, styrene-butadiene resins, vinylidene chloride-acrylonitrile resins, vinyl chloride-vinyl acetate resins, vinyl chloride-vinyl acetate-maleic anhydride resins, silicone resins, silicone alkid resins, phenol-formaldehyde resins, polyvinyl acetal resins and polyvinyl butyral resins.

The thickness of the charge generation layer is generally 0.1 to 5.0 μm, and preferably 0.2 to 2.0 μm.

(5) Charge transport layer

The charge transport layer contains a charge transport material. The charge transport material is not specific to the following and may include oxazole derivatives, oxadiazole derivatives, thiazole derivatives, thiadiazole derivatives, triazole derivatives, imidazole derivatives, imidazolone derivatives, imidazoline derivatives, bisimidazolidine derivatives, styryl compounds, hydrazone compounds, benzidine compounds, pyrazoline derivatives, stilbene compounds, amine derivatives, oxazolone derivatives, benzothiazole derivatives, benzimidazole derivatives, quinazoline derivatives, benzofurane derivatives, acridine derivatives, phenadine derivatives, aminostilbene derivatives, poly-N-vinylcarbazole derivatives, poly-1-vinyl pyrenes, and poly-9-vinyl anthracenes.

One or more kinds of these materials can be dispersed in a resin or dissolved in a solvent.

As resins in which the charge transport material is dispersed or dissolved, the above-described resins, in which the charge generation material is dispersed, can be listed as an example. The film thickness of the charge transport layer is generally 5–50 μm, and preferably 10–40 μm.

(6) Photosensitive layer

The photosensitive layer contains a charge generation material and a charge transport material. The photosensitive layer is formed when the charge transport material and the charge generation material are appropriately mixed and the mixture is dispersed in the above described resin.

The thickness of the photosensitive layer is generally 5–50 μm, and preferably 10–40 μm.

(7) Fine particle-containing surface layer

The fine particle-containing surface layer is a protective layer in which fine particles are contained. Any kind of inorganic fine particles and organic fine particles can be used as the fine particles.

The inorganic fine particles, which are contained in the inorganic fine particle containing surface layer, are not specifically limited, and are preferably inorganic compounds having a Mohs hardness of not less than 5. The inorganic fine particles includes oxides such as titanium oxide, silica, zirconium oxide and alumina, nitrides such as carbon nitride, aluminum nitride and silicon nitride, a carbonite such as silicon carbonite and titanates such as strontium titanate and barium titanate.

Herein, Mohs hardness is a relative hardness evaluated by the existence of scratchs, in which the hardness of talc is designated as 1 and the hardness of diamond is designated as 10.

The organic fine particles, which are contained in the organic fine particle-containing surface layer, are not specifically limited, but specifically, cross linked organic fine particles are preferable. Herein, "cross linked organic fine particles" are designated to be organic fine particles in which insoluble portions in a solvent are not less than 30%.

The examples of organic compounds constituting organic fine particles include vinyl type organic compounds obtained by polymerization of vinyl monomers, for example, styrene or its derivatives such as o-methylstyrene, m-methylstyrene, p-methylstyrene, α-methylstyrene, p-chlorostyrene, 3,4-dichlorostyrene, p-phenylstyrene, p-ethylstyrene, 2,4-dimethylstyrene, p-t-butylstyrene, p-n-hexylstyrene, p-n-octylstyrene, p-n-nonylstyrene, p-n-decylstyrene, and p-n-dodecylstyrene, methacrylate derivatives such as methylmethacrylate, ethylmethacrylate, isopropylmethacrylate, n-butylmethacrylate, isobutylmethacrylate, t-butylmehtacrylate, n-octylmethacrylate, 2-ethylhexylmethacrylate, stearylmethacrylate, laurylmethacrylate, phenylmethacrylate, diethylaminoethylmethacrylate and dimethylaminoethylmethacrylate, acrylate derivatives such as methylacrylate, ethylacrylate, isopropylacrylate, n-butylacrylate, isobutylacrylate, t-butylacrylate, n-octylacrylate, 2-ethylhexylacrylate, stearylacrylate, laurylacrylate, and phenylacrylate, olefins such as ethylene, propylene and isobutylene, vinyl halides such as vinyl chloride, vinylidene chloride, vinyl bromide and vinyl fluoride, vinyl esters such as vinyl propionate, vinyl acetate and vinyl benzoate, vinyl ethers such as vinyl methyl ether and vinyl ethyl ether, vinyl ketones such as vinyl methyl ketone, vinyl ethyl ketone and vinyl hexyl ketones, N- vinyl compounds such as N-vinyl carbazol, N-vinyl indole and N-vinyl pyrrolidone, vinyl compounds such as vinyl naphthalene and vinyl pyridine, acrylonitril, methacrylonitril or acrylamide pyrrolidone, with polyfunctional vinyl monomers, for example, divinyl benzene, ethylene glycol diacrylate, ethylene glycol dimethacrylate, diethylene glycol diacrylate, diethylene glycol dimethacrylate, triethylene glycol diacrylate, triethylene glycol dimethacrylate, trimethylolpropne trimethacrylate, and trimethylolpropne triacrylate, organic polycondensate fine particles such as polyurethanes obtained by polycondensation of polyisocyanates with polyamines, polyureas, cross-linked polyesters and cross-linked silicone resins.

As the particle size of the fine particles contained in the fine particle-containing surface layer, it is preferable that the number average primary particle size is 0.01–5 μm, and more preferably 0.05–2 μm. When the particle size of the fine particles is excessively large, the fine particle-containing surface layer becomes brittle, resulting in a decrease of the pre-expected durability. Further, there is a possibility that a cleaning mechanism is deteriorated by the existence of excessively large-sized fine particles. On the other hand, when the particle size of the fine particles is excessively small, effects of an increase of the surface hardness are not exhibited, and effects of an increase of the durability are not fully exhibited.

It is preferable that a volume resistance of the fine particles contained in the fine particle-containing surface layer is not less than $10^8\Omega$ cm. When the volume resistance is not higher than $10^8\Omega$ cm, charge maintaining functions are reduced as the surface resistance decreases, resulting in induction of the occurrence of image defects.

The fine particle-containing surface layer can be formed when the organic fine particles or the inorganic fine particles are dispersed in resins, and coated on the charge transport layer or the photosensitive layer. As resins in which fine particles are dispersed, the above-described resins constituting other layers (a charge generation layer, a charge transport layer, and a photosensitive layer) are listed as an example.

A containing ratio of fine particles in the fine particle-containing surface layer, is 1–200 weight parts with respect to the resins of 100 weight parts, and preferably it is 5–100 weight parts. When the fine particle containing ratio is not more than 1 weight part, effects of the increase of the surface hardness can not be exhibited. On the other hand, when the containing ratio is not less than 200 weight parts, although effects of the increase of the surface hardness are exhibited, light scatters in the exposure process due to the excessively existing fine particles, causing in image defects.

The film thickness of the fine particle-containing surface layer is generally 0.2–10 μm, and preferably 0.4–5 μm. When the film thickness is excessively thin, the effects of an increase of the durability can not fully be exhibited, and light scattering easily occurs, resulting in image defects or reduction of sensitivity.

It is preferable that the charge transport material is contained in the fine particle-containing surface layer. When the charge transport material is contained in the same manner as in the charge transport layer, the charge is uniformly transported, and the charge distribution can be stably formed corresponding to the image. Herein, a containing ratio of the charge transport material in the fine particle-containing surface layer, is 30–300 weight parts with respect to resins of 100 weight parts, and preferably 50–200 weight parts.

Composition of the developer (1) Composition

Toner, constituting developers used in the image forming method of the present invention, contains binder resins, coloring agents, polyolefine releasing agents, and additives, which are used as necessary, and the present invention is characterized in the distribution of molecular weight of polyolefines. Herein, the average particle size of toner is 1–30 μm in terms of volume average particle size, and preferably 5–20 μm.

(2) Polyolefine

As a polyolefine, which is a releasing agent and constitutes toner, polypropylene, ethylene-propylene copolymer, etc., can be listed, but polypropylene is preferable.

In this polyolefine, a ratio of Z average molecular weight in terms of polypropylene to number average molecular weight in terms of polypropylene, (Mz/Mn), is 3–20. When this ratio (Mz/Mn) is not larger than 3, the shape of a molecular weight distribution is sharp, and the offset prevention effects in a fixing portion can not be fully exhibited. On the other hand, when the ratio (Mz/Mn) is not less than 20, the number average molecular weight (Mn) is reduced, and the low molecular weight components can not be reduced. There is a possibility that the low molecular weight components adhere to the photoreceptor surface, and thereby, cause image defects to occur.

Further, in polyolefine, Z average molecular weight (Mz) in terms of polypropylene is 20,000–70,000. When Z average molecular weight (Mz) is not more than 20,000, the molecular weight can not be increased, and therefore, the problem of adherence to the photoreceptor surface can not be overcome. Z average molecular weight (Mz) is preferably not more than 70,000 so that offset prevention effects can be fully exhibited.

Herein, values of the number average molecular weight (Mn) in terms of polypropylene and the Z average molecular weight (Mz) in terms of polypropylene are specified to be measured by the high temperature GPC (gel permeation chromatography). Specifically, o-dichrolobenzene, in which ionol of 0.1% is added, is used as a solvent, and this solution is caused to flow out at the temperature condition of 135° C.; the refractive index of the solution is detected by a differential refractive index detector; and the average molecular weight is found by converting the molecular weight into the absolute molecular weight in terms of polypropylene by a universal correction method.

The synthetic method of polyolefine, constituting toner, is not specifically limited, but generally the polyolefine can be prepared by thermal decomposition of a high molecular polyolefine, in its fused condition, obtained according to ordinary methods. The adjustment of the molecular weight is carried out by fractionating the molecular weight so as to be within the range of a predetermined molecular weight by means of the above described high temperature GPC.

The polyolefine is a releasing agent, which constitutes toner, and the polyolefine content of the toner is preferably 0.5 to 5.0% by weight, and more preferably 1.0 to 4.0% by weight based on the toner weight. When the polyolefine content is excessive, the amount of the releasing agent present on the surface of the toner is also excessive, resulting in deterioration of toner fluidity. When the polyolefine content is too small, prevention of offset during fixing is insufficient.

(3) Binder resin

The binder resin, which constitutes toner, is not specifically limited, and various conventional resins may be used. The resins include styrene type resins, acryl type resins, styrene-acrylate resins and polyester type resins.

(4) Coloring agent

The coloring agent, which constitutes toner, is not specifically limited, and various conventional coloring agents may be used. The coloring agent includes carbon black, nigrosine dyes, aniline blue, calco oil blue, chrome yellow, ultramarine blue, Dupont oil red, quinoline yellow, methylene blue chloride, phthalocyanine blue, malachite green oxalate and rose bengal.

(5) Additives

Other additives, which may optionally be used, include, for example, a charge controlling agent such as a salicylic acid derivative or an azo metal complex. In order to obtain a magnetic toner, magnetic particles are added to coloring particles composed of a coloring agent and a binder resin. As the magnetic particles, particles composed of ferrite or magnetite having a primary average particle size of 0.1 to 2.0 μm are used. The amount of the magnetic particles is 20 to 70% by weight based on the weight of coloring agent.

In view of improving fluidity of the toner, inorganic fine particles may be added. Preferable inorganic fine particles include silica, titanium oxide, and aluminum oxide, and barium titanate. These inorganic fine particles are preferably subjected to hydrophobic treatment by a silane coupling agent or a titanium coupling agent.

The developer used in the image forming method of the invention may be a two-component developer, in which the above described toner is mixed with a carrier, or a one-component developer composed of only the above described magnetic toner.

As a carrier, constituting a two-component developer, any conventional carrier may be used. Any of a non-covered carrier consisting only of magnetic particles such as iron or ferrite, and a resin-covered carrier in which the surface of magnetic particles is covered with a resin or the like, may be used as the carrier. The carrier has a volume average particle diameter of preferably 30 to 150 μm.

Cleaning mechanism

In the image forming method of the present invention, toner, which was not transferred onto the image supporting body and remains on the photoreceptor, is cleaned off. A cleaning method is not specifically limited, and a blade method, a magnetic brush method, a fur brush method, etc., which are obvious to those skilled in the art, may be used. In these methods, a blade method is preferable in which an elastic blade is pressure-contacted with the photoreceptor surface to clean off any remaining toner.

Figure 2:
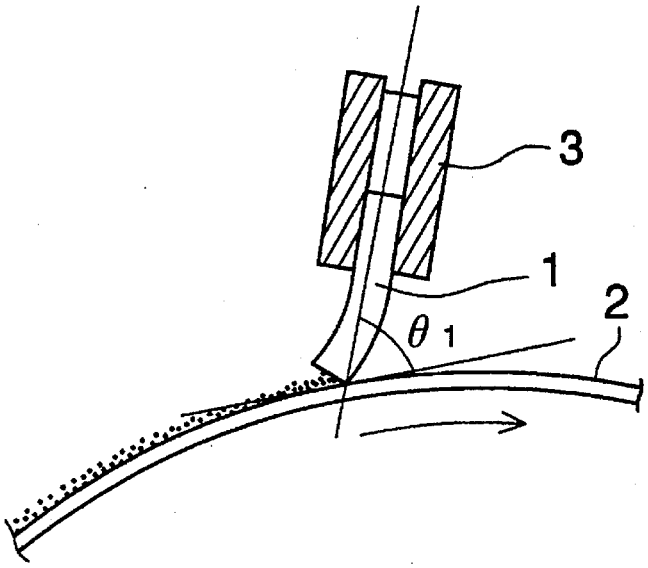
FIG. 2 is an illustration showing another example of a motion of the cleaning mechanism.

FIGS. 1 and 2 are illustrations showing the operation of a cleaning mechanism using the blade method. In FIGS. 1 and 2, an intersection angle $\theta_1$ formed by a holder 3 and the photoreceptor 2, is normally 10°–90°, and preferably 15°–75°. Silicone rubber, urethane rubber, or the like, may be used for an elastic material for the blade 1. The hardness (JIS-A) of such an elastic material is preferably 30°–90°. The thickness of blade 1 is preferably 1.5–5 mm, and its length (the external length of the holder 3) is preferably 5–20 mm. The pressure-contact force with the photoreceptor is appropriately 5–50 gf/cm.

EXAMPLES

Examples of the present invention will be described below. In the following description, "part" means "weight part".

Production of polypropylene

Polypropylene adjusted by a normal synthesizing method, is thermally decomposed under melting condition, and fractionated by a high temperature GPC as necessary. Then, polypropylene (PP-1–5 (for the present invention) and pp-1–6 (for comparison)), having respectively a Z-average molecular weight (Mz) in terms of polypropylene, and the number average molecular weight (Fin) in terms of polypropylene, are obtained as shown in Table 1, to be-shown later.

In this case, the molecular weight was measured by the high temperature GPC (GPC-150C, made by Waters Co. ) using SHODEX HT-806 as a column of the GPC. O-dichlorobenzene to which 0.1% ionol is added was used as a solvent, and was subjected to flow at a flow velocity of 1.0 ml per minute at the temperature of 135 ° C.

TABLE 1

| Types of polypropylene | | Z average molecular weight (Mz) | Number average molecular weight (Mn) | Mz/Mn |
|---|---|---|---|---|
| For present invention | PP-1 | 21,000 | 6,400 | 3.3 |
| | PP-2 | 33,000 | 7,300 | 4.5 |
| | PP-3 | 56,000 | 7,400 | 7.6 |
| | PP-4 | 63,000 | 5,300 | 11.9 |
| | PP-5 | 65,000 | 3,400 | 19.1 |
| For comparison | pp-1 | 19,000 | 8,300 | 2.3 |
| | pp-2 | 18,000 | 840 | 21.4 |
| | pp-3 | 16,000 | 3,400 | 4.7 |
| | pp-4 | 73,000 | 33,000 | 2.2 |
| | pp-5 | 73,000 | 3,300 | 22.1 |
| | pp-6 | 73,000 | 12,000 | 6.1 |

Adjustment of developer

Styrene-acrylic resin of 100 parts, carbon black of 6 parts, and each polypropylene of 4 parts, shown in the following table 2, were mixed together, melted and kneaded, powdered after cooling, classified, and then, colored particles having volume average particle size of 8.4 μm were obtained. Toners 1–5 for the present invention and comparative toners 1–6 were produced by adding hydrophobic silica to the obtained colored particles so that the hydrophobic silica was 0.8 weight %. Each toner shown in the following Table 2, was mixed with a ferrite carrier (having volume average particle size of 65 μm), the surface of which was coated by styrene-acrylic resin, and two-component developers (developers 1–5 and comparative developers 1–6), in which toner density was 7 weight %, were prepared.

TABLE 2

| Developer | Toner | Polypropylene |
|---|---|---|
| Developer 1 | Toner 1 | PP-1 |
| Developer 2 | Toner 2 | PP-2 |
| Developer 3 | Toner 3 | PP-3 |
| Developer 4 | Toner 4 | PP-4 |
| Developer 5 | Toner 5 | PP-5 |
| Comparative developer 1 | Comparative toner-1 | pp-1 |
| Comparative developer 2 | Comparative toner-2 | pp-2 |
| Comparative developer 3 | Comparative toner-3 | pp-3 |
| Comparative developer 4 | Comparative toner-4 | pp-4 |
| Comparative developer 5 | Comparative toner-5 | pp-5 |
| Comparative developer 6 | Comparative toner-6 | pp-6 |

Production of photoreceptor

Photoreceptors 1–7 were produced by the following four processes.

1. The foundation layer, made of polyamide resin, the thickness of which is 0.3 μm, is formed on an aluminum drum, the diameter of which is 80 mm.

2. A mixed and dispersed solution of perylene compound (charge generation material) of 30 parts, and the charge generation material, composed of polyvinyl butyral of 10 parts and methyl ethyl ketone of 1600 parts, is prepared, and then coated on the foundation layer. The charge generation layer, the thickness of which is 0.3 μm, is formed by drying the coated solution.

3. A solution of the charge transport material, in which styryl compounds (charge transport material) of 500 parts, bisphenol Z type polycarbonate resins of 600 parts, and dichloromethane of 3000 parts are mixed, is prepared. This solution is coated on the charge generation layer, and the charge transport layer, the thickness of which is 25 μm, is formed by drying the coated solution.

4. Styryl compounds of 100 parts are added in bisphenol Z type polycarbonate resin of 100 parts, and then, resin components containing the charge transport material are prepared. Next, inorganic particles or organic particles are dispersed in these resin components and a dispersion solution is prepared according to a prescription shown in the following Table 3. This dispersion solution is coated on the charge transport layer, and the surface layer, containing high hardness fine particles, the thickness of which is 4.0 μm, is formed, after drying the coated solution.

TABLE 3

| Photo-receptor | Fine particles in the surface layer | Mohs' hard-ness | Cross linking degree (%) | Number average primary particle size (μm) | Addition amount (part) |
|---|---|---|---|---|---|
| 1 | Silica | 7.0 | — | 0.1 | 60 |
| 2 | Silica | 7.0 | — | 0.3 | 55 |
| 3 | Titanium oxide | 6.0 | — | 0.3 | 70 |
| 4 | Barium titanate | 5.0 | — | 0.9 | 100 |
| 5 | Stront-ium titanate | 5.0 | — | 1.2 | 120 |
| 6 | Cross linked styrene-acrylic resin | — | 42 | 1.4 | 70 |
| 7 | Cross linked styrene-acrylic resin | — | 68 | 1.8 | 100 |

In the cross linked styrene-acrilic resin fine particles, of which the fine particle-containing surface layers of the photoreceptor 6 and the photoreceptor 7 are composed, divinylbenzene is used as cross linking agents, and the particle size and the cross linking degree are adjusted by an emulsion polymerization method or a seed polymerization method. In the cross linking degree of resin fine particles, a portion, insoluble in methyl ethyl ketone, is measured, and the insoluble portion when no cross linking agent (divinyl benzene) is used, is 0%.

Example and comparative example (evaluation)

The developers and the photoreceptors were selected according to a combination shown in the following Tables 4 and 5. Actual image-copying operations were carried out by an electrophotographic copier "UBix-3135" made by Konica Co. The following items were evaluated.

(1) Black-spot image defects and offset phenomena 50,000 cycles of printing were conducted at a 5% pixel ratio under the high temperature and high humidity circumstance (at temperature of 33° C. and relative humidity of 80%RH), and white paper is printed for each 2000 cycles. Image defects were evaluated at the number of copy cycles at which black-spots, the diameter of which is more than 0.3 mm, occur, or the number of copy cycles, at which toner-staining due to offset phenomena, occur. These results are also shown in Table 4.

(2) Fogging

Continuous printing was carried out under the high temperature and high humidity circumstance (at the temperature of 33° C. and the relative humidity of 80%RH). The reflection density on the white background portion was measured by a "Sakura densitometer" (made by Konica Co.), and the number of copying operations at which the relative reflection density (the reflection density of the paper itself is 0), was more than 0.02, was evaluated. These results are also shown in Table 5.

As a cleaning method, a blade method using a cleaning mechanism as shown in FIG. 2 was adopted. The blade 1 was made of urethane rubber (the hardness is 65° according to JIS-A), the thickness of which is 3 mm, and the length of which (the external length of a holder 3) is 8 mm. The intersection angle $\theta_1$ between the holder 3 and the photoreceptor 2 is 22°, and the pressure-contact force to the photoreceptor is 15 gf/cm.

TABLE 4

| | Black-spot image defects and offset phenomena | | | | | | |
|---|---|---|---|---|---|---|---|
| | Photo-receptor 1 | Photo-receptor 2 | Photo-receptor 3 | Photo-receptor 4 | Photo-receptor 5 | Photo-receptor 6 | Photo-receptor 7 |
| Developer 1 | None | None | None | None | None | None | None |
| Developer 2 | None | None | None | None | None | None | None |
| Developer 3 | None | None | None | None | None | None | None |
| Developer 4 | None | None | None | None | None | None | None |
| Developer 5 | None | None | None | None | None | None | None |
| Comparative Developer 1 | 36,000 | 36,000 | 36,000 | 36,000 | 36,000 | 36,000 | 36,000 |
| Comparative Developer 2 | 24,000 | 28,000 | 26,000 | 24,000 | 24,000 | 32,000 | 32,000 |
| Comparative Developer 3 | 38,000 | 42,000 | 36,000 | 42,000 | 42,000 | 42,000 | 42,000 |
| Comparative Developer 4 | 24,000 | 24,000 | 24,000 | 24,000 | 24,000 | 24,000 | 24,000 |
| Comparative Developer 5 | 38,000 | 42,000 | 36,000 | 42,000 | 40,000 | 42,000 | 42,000 |

In the above table, the number of copying-cycles at which the offset phenomena occurred is shown in Comparative Developers 1, 4, 6. The number of copying-cycles at which black-spots occurred is shown in Comparative Developers 2, 3, 5.

TABLE 5

| | Fogging | | | | | | |
|---|---|---|---|---|---|---|---|
| | Photo-receptor 1 | Photo-receptor 2 | Photo-receptor 3 | Photo-receptor 4 | Photo-receptor 5 | Photo-receptor 6 | Photo-receptor 7 |
| Developer 1 | None | None | None | None | None | None | None |
| Developer 2 | None | None | None | None | None | None | None |
| Developer 3 | None | None | None | None | None | None | None |
| Developer 4 | None | None | None | None | None | None | None |
| Developer 5 | None | None | None | None | None | None | None |
| Comparative Developer 1 | 34,000 | 34,000 | 36,000 | 36,000 | 36,000 | 36,000 | 36,000 |
| Comparative Developer 2 | 24,000 | 28,000 | 24,000 | 24,000 | 26,000 | 32,000 | 32,000 |
| Comparative Developer 3 | 36,000 | 44,000 | 36,000 | 42,000 | 44,000 | 42,000 | 42,000 |
| Comparative Developer 4 | 24,000 | 26,000 | 26,000 | 26,000 | 26,000 | 24,000 | 24,000 |
| Comparative Developer 5 | 38,000 | 42,000 | 36,000 | 44,000 | 42,000 | 42,000 | 42,000 |
| Comparative Developer 6 | 34,000 | 34,000 | 36,000 | 36,000 | 36,000 | 34,000 | 36,000 |

Due to the image forming method of the present invention, a stable image with no offset phenomena and no image defects such as fogging or black-spots, is realized for a long period of time.

We claim:

1. An image forming method comprising a development process in which an electrostatic latent image on a photoreceptor is developed by developer comprising a toner, wherein the photoreceptor is an organic photoreceptor having a layer containing fine particles at the surface of the photoreceptor; the toner has at least binder resin, coloring agent and releasing agent, the releasing agent consisting of polyolefine of which a ratio (Mz/Mn) is 3–20, and Mz is 20,000–70,000, wherein Mz is Z-average molecular weight in terms of polypropylene and Mn is the number average molecular weight in terms of polypropylene.

2. An image forming method as claimed in claim 1 wherein the organic photoreceptor comprises a charge generation layer, a charge transport layer.

3. An image forming method as claimed in claim 2 wherein the thickness of the charge generation layer is generally 0.1 to 5.0 μm.

4. An image forming method as claimed in claim 2 wherein the thickness of the charge transport layer is generally 5–50 μm.

5. An image forming method as claimed in claim 1 wherein the organic photoreceptor comprises a photosensitive layer containing a charge generation material and a charge transport material as a mixture.

6. An image forming method as claimed in claim 1 wherein the thickness of the photosensitive layer is generally 5–50 μm.

7. An image forming method as claimed in claim 1 wherein the fine particles are inorganic fine particles having a Mohs hardness of not less than 5.

8. An image forming method as claimed in claim 1 wherein the fine particles are cross linked organic fine particles.

9. An image forming method as claimed in claim 1 wherein the number average primary particle size of the fine particles is 0.01–5 μm.

10. An image forming method as claimed in claim 1 wherein the polyolefine is polypropylene.

* * * * *